US008376423B2

(12) United States Patent
Lesjak

(10) Patent No.: US 8,376,423 B2
(45) Date of Patent: Feb. 19, 2013

(54) MECHANISM FOR LOCKING A DOOR OF AN ELECTRIC HOUSEHOLD APPLIANCE

(75) Inventor: Zvonko Lesjak, Tolmin (SI)

(73) Assignee: ITW Metalflex, D.O.O. Tolmin, Tolmin (SI)

( * ) Notice: Subject to any disclaimer, the term of this patent is extended or adjusted under 35 U.S.C. 154(b) by 191 days.

(21) Appl. No.: 12/922,459

(22) PCT Filed: Apr. 27, 2009

(86) PCT No.: PCT/IB2009/051713

§ 371 (c)(1),
(2), (4) Date: Sep. 14, 2010

(87) PCT Pub. No.: WO2009/133514

PCT Pub. Date: Nov. 5, 2009

(65) Prior Publication Data

US 2011/0006548 A1 Jan. 13, 2011

(30) Foreign Application Priority Data

Apr. 28, 2008 (SI) ..... P-200800109

(51) Int. Cl.
*E05B 63/20* (2006.01)
*E05B 15/02* (2006.01)

(52) U.S. Cl. ..... 292/333; 292/332; 292/341.15; 292/341.17; 292/DIG. 4

(58) Field of Classification Search ..... 292/57, 292/58, 65, 71, 83, 332, 333, 341.15, 341.17, 292/DIG. 4
See application file for complete search history.

(56) References Cited

U.S. PATENT DOCUMENTS 2,637,576 A * 5/1953 Nottingham ..... 292/99
2,956,827 A * 10/1960 Humphries ..... 292/99
(Continued)

FOREIGN PATENT DOCUMENTS

DE 19753319 A1 7/1998
EP 1424529 A 6/2004
(Continued)

OTHER PUBLICATIONS

Aluminum + Automobil: Lectures held on an International Symposium Organized by the Aluminum-Zentrale, Dusseldorf, 1980.*

(Continued)

*Primary Examiner* — Carlos Lugo
*Assistant Examiner* — Alyson M Merlino
(74) *Attorney, Agent, or Firm* — Lowe Hauptman Ham & Berner, LLP

(57) ABSTRACT

A mechanism for locking a door of an electric household appliance is improved in that a slider jaw is hinged to a body of a slider in such manner that, by its tooth, it snaps or releases a head of a latch and that the slider jaw is provided with an opening finger, and a mechanism housing is provided with a hindering element, which thrusts the opening finger of the slider jaw, when the slider moves in direction of the force of the spring, so that the slider jaw gets open. The slider body and the slider jaw are preferably made of different materials: the slider body of a polyoxymethylene copolymer and the slider jaw of a polyamide or of a ZL4 alloy having a composition Zn:A14:Cu1. The proposed mechanism is not susceptible to plastic deformation of the junction area between the slider body and the slider jaw.

7 Claims, 2 Drawing Sheets

U.S. PATENT DOCUMENTS

| | | | | | |
|---|---|---|---|---|---|
| 4,383,707 | A | | 5/1983 | Nishimura | |
| 4,482,175 | A | * | 11/1984 | Sugie | 292/45 |
| 4,655,489 | A | * | 4/1987 | Bisbing | 292/110 |
| 4,660,871 | A | * | 4/1987 | Arakawa et al. | 292/81 |
| 4,792,165 | A | * | 12/1988 | Nishimura | 292/19 |
| 5,090,751 | A | * | 2/1992 | Kobayashi | 292/71 |
| 5,217,262 | A | * | 6/1993 | Kurosaki | 292/6 |
| 5,273,328 | A | * | 12/1993 | Kurosaki | 292/336.3 |
| 5,292,158 | A | * | 3/1994 | Kurosaki | 292/45 |
| 5,401,067 | A | * | 3/1995 | Kurosaki et al. | 292/63 |
| 5,518,282 | A | * | 5/1996 | Sawada | 292/252 |
| 5,775,748 | A | * | 7/1998 | Kurachi | 292/341.15 |
| 5,984,381 | A | * | 11/1999 | Yamagishi | 292/45 |
| 5,997,056 | A | * | 12/1999 | Yamagishi | 292/341.17 |
| 6,250,694 | B1 | * | 6/2001 | Weiland | 292/110 |
| 6,719,337 | B1 | * | 4/2004 | Ji | 292/341.17 |
| 6,869,114 | B2 | * | 3/2005 | Ueki | 292/341.17 |
| 6,986,335 | B2 | * | 1/2006 | Sieber et al. | 123/320 |
| 7,002,092 | B2 | * | 2/2006 | Ichimaru | 200/523 |
| 7,032,939 | B2 | * | 4/2006 | Magnusson | 292/333 |
| 7,108,298 | B2 | * | 9/2006 | Huet et al. | 292/6 |
| 7,165,790 | B2 | * | 1/2007 | Bella et al. | 292/34 |
| 7,201,409 | B2 | * | 4/2007 | Adachi et al. | 292/304 |
| 7,278,664 | B2 | * | 10/2007 | Su et al. | 292/304 |
| 7,393,026 | B2 | * | 7/2008 | Ikeda et al. | 292/341.15 |
| 7,607,703 | B2 | * | 10/2009 | Cho | 292/304 |
| 7,766,407 | B2 | * | 8/2010 | Nakaya | 296/24.34 |
| 8,038,184 | B2 | * | 10/2011 | Grigis | 292/80 |

FOREIGN PATENT DOCUMENTS

| | | | | |
|---|---|---|---|---|
| EP | 1596030 | A | | 11/2005 |
| JP | 04064677 | A | * | 2/1992 |
| JP | 07054531 | A | | 2/1995 |
| JP | 08232530 | A | | 9/1996 |
| JP | 2006022543 | A | | 1/2006 |

OTHER PUBLICATIONS

Alumasc Precision—Aluminum and Zinc Alloy Charts—ZL5, http://www.alumasc-precision.co.uk/AlloyZL5.php.*

ISR for PCT/IB2009/051713 mailed Aug. 5, 2009.

* cited by examiner

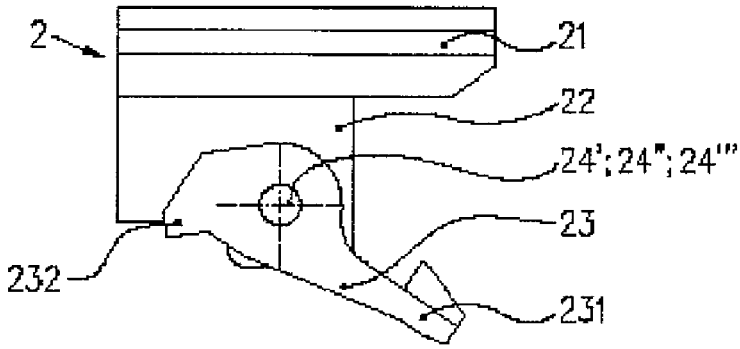
Fig.3
Fig.4a
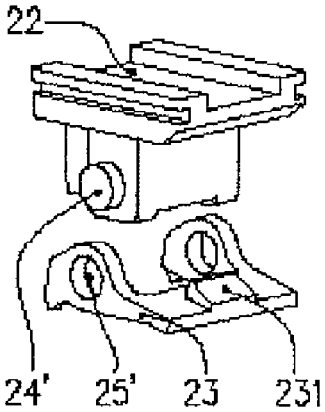
Fig.4b
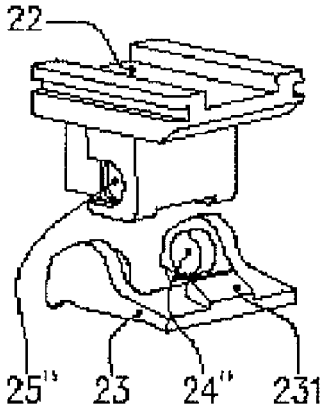
Fig.4c
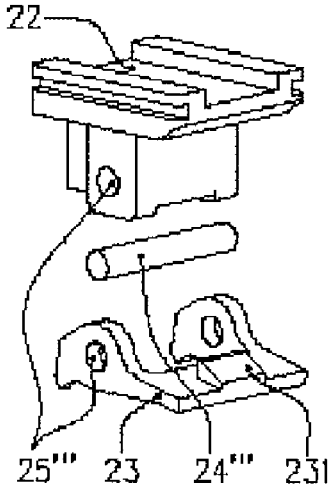
Fig.5a
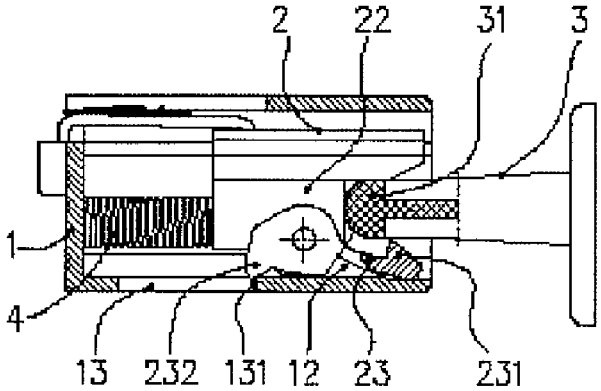
Fig.5b
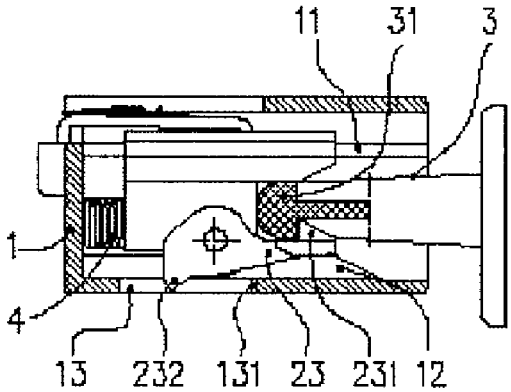

MECHANISM FOR LOCKING A DOOR OF AN ELECTRIC HOUSEHOLD APPLIANCE

RELATED APPLICATIONS

The present application is national phase of International Application Number PCT/IB2009/051713 filed Apr. 27, 2009, and claims priority from, Slovenia Application Number P-200800109 filed Apr. 28, 2008.

BACKGROUND

The invention relates to a mechanism for locking a door of an electric household appliance, e.g. an electric clothes-dryer, the mechanism being provided with a housing, a slider that is provided with a labyrinth to define direction of a displacement of the slider at a single thrust on the slider, a latch, which is fastened to the door of the electric household appliance and thrusts the slider when closing and opening the door of the electric household appliance and whose head is snapped by a tooth of a slider jaw when closing the door of the electric household appliance, and with a spring, said slider being translatory movable in the housing in direction against the force of the spring during closing the door of the electric household appliance and in direction of the force of the spring during opening the door of the electric household appliance and said housing being provided with a cam lobe that lifts the slider jaw and closes it hereby, when the latch thrusts the slider in the direction against the force of the spring.

There is known an applicant's mechanism for locking a door of an electric household appliance having push-push and push-pull functions as described above (FIGS. 1, 2*a* and 2*b*).

The mechanism is provided with a housing 1', a slider 2' that is provided with a labyrinth defining direction of displacement of the slider 2' at a single thrust on the slider 2', a latch 3 that is fastened to the door of the electric household appliance and thrusts a body 22 of the slider 2' when closing and opening the door of the electric household appliance and whose head 31 is snapped by a tooth 231 of a slider jaw 23' when closing the door of the electric household appliance, and with a spring 4. The slider jaw 23' is embodied in one piece together with the slider body 22 of a plastic material, e.g. polypropylene.

The slider 2' is translatory movable in the housing 1' by means of an assembly of a guiding groove 21 and a guiding cam 11 in the direction against the force of the spring 4 during closing the door of the electric household appliance and in the direction of the force of the spring 4 during opening the door of the electric household appliance.

The housing 1' is provided with a cam lobe 12 lifting the slider jaw 23' against the force of elasticity of a junction area 22-23' between the slider body 22 and the slider jaw 23' from the opened position, and closes it, when the latch 3 thrusts the slider 2' in direction against the force of the spring 4. Now the tooth 231 snaps the latch head 31 blocking hereby the latch 3 from being pulled out at a moderate force, however, when needed the door opening is possible with a slightly greater pulling-out force (push-pull).

The door is opened by a repeated thrust of the latch 3 on the slider 2' (push-push) in order to cause a jump-over in the labyrinth. Then the spring 4 thrusts the slider 2' in the outwards direction. Hereby the force of elasticity of the junction area 22-23' between the slider body 22 and the slider jaw 23' opens the slider jaw 23'.

The material of the slider 2' and that of the jaw 23' as well does not guarantee a permanently constant elasticity of the junction area 22-23'. Due to elevated temperature in a household appliance of the described type, said elasticity decreases faster than it would otherwise. The locking mechanism is usually foreseen for temperatures in a range from 0° C. to 70° C.

After used for a longer period of time, the latch 3 tends to stuck when the door is opened. When plastic deformation of the junction area 22-23' between the slider body 22 and the slider jaw 23' is yet more considerable, the latch 3 thrusts the slider 2' upon closing the door so that jump-over occurs in the labyrinth, but the tooth 231 of the slider jaw 23' fails to snap the latch head 31. The door of an electric household appliance remains unlocked.

The technical problem of the invention is how to provide for fastening of a slider jaw to a slider body and for a cooperation of a slider jaw with other parts of the mechanism for locking a door of an electric household appliance, in order that a restoring torque for opening the slider jaw will be provided by a force, which is not elasticity force of a junction area between the slider body and the slider jaw.

Said technical problem is solved by a mechanism of the invention for locking a door of an electric household appliance having the features cited in the characterizing portion of the first claim and the variants of the embodiment being characterized by the features of the dependent claims.

The mechanism, as improved by the invention, for locking an door of the electric household appliance distinguishes itself in that it is not susceptible to plastic deformation of the junction area between the slider body and the slider jaw. The slider body and the slider jaw are two separate parts being mutually form-locked, so both can be made of the same material, but preferably of two different materials.

BRIEF DESCRIPTION OF THE DRAWINGS

These and other objects of the present invention will be appreciated and understood by those skilled in the art from the detailed description of the preferred embodiments of the invention and the following drawings of which:

FIG. 3 is a side view of a slider of the locking mechanism,

FIGS. 4*a*, 4*b* and 4*c* are perspective views of alternative connections between a body of the slider and a slider jaw, and;

FIGS. 5*a* and 5*b* are side views of the mechanism in which a latch is only inserted in an opening foreseen for it and the latch is locked by the mechanism, respectively.

DETAILED DESCRIPTION OF THE PREFERRED EMBODIMENTS

Figure 1:
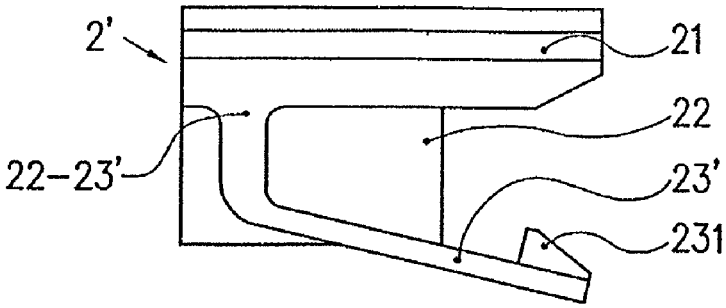
Fig.1 (PRIOR ART)
FIGS. 1, 2*a*, and 2*b* are side sectional views of prior art locking door mechanisms.
Figure 2A:
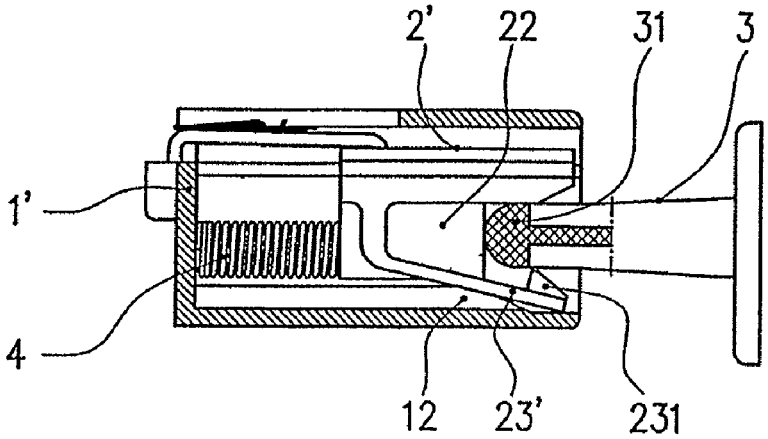
Fig.2a (PRIOR ART)
Figure 2B:
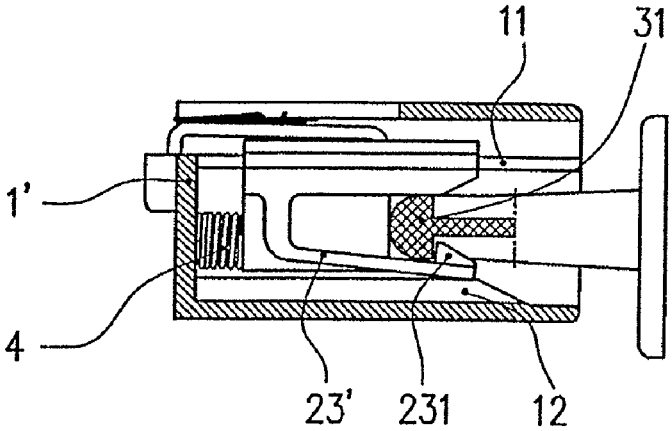
Fig.2b (PRIOR ART)

A mechanism of the invention for locking a door of an electric household appliance is represented in FIG. 5*a* in the position of the unlocked door of a household appliance and in FIG. 5*b* in the position of the locked door of a household appliance The mechanism of the invention consists of a housing 1, a slider 2, a latch 3 and a spring 4 is developed from the represented known mechanism of the same type, in that it is improved by the following constructional refinements.

According to the invention, a slider jaw 23 is hinged to a body 22 of the slider 2 in such manner that it snaps or releases a head 31 of the latch 3 by its tooth 231 (FIG. 3).

The following variants are foreseen. The slider body 22 is provided with two axle pins 24' and the slider jaw 23 is provided with two axle holes 25', which accommodate said axle pins 24' (FIG. 4*a*). Further, the slider jaw 23 is provided with two axle pins 24" and the slider body 22 is provided with two axle holes 25", which accommodate said axle pins 24". And finally, the slider body 22 and the slider jaw 23 may be provided with axle holes 25''', which accommodate an axle pin 24'''.

According to the invention, the slider jaw 23 is provided with an opening finger 232 and, according to the invention, the housing 1 is provided with a hindering element 131. When the slider 2 moves in direction of the force of the spring 4, the hindering element 131 thrusts the opening finger 232 of the slider jaw 23, so that the slider jaw 23 opens under said thrust.

To this purpose the housing 1 may be provided with a through hole 13, into which the opening finger 232 protrudes, when the slider jaw 23 is closed. When the slider 2 moves in the direction of the force of the spring 4, the edge 131 of the through hole 13 functioning as the hindering element thrusts the opening finger 232 of the slider jaw 23.

The slider body 22 and the slider jaw 23 are preferably made of two different materials.

According to a first variant embodiment, the body 22 of the slider 2 is made of a polyoxymethylene copolymer and the slider jaw 23 is made of polyamide. The hostaform has good antifriction properties.

According to a second variant embodiment, the body 22 of the slider 2 is made of a polyoxymethylene copolymer and the slider jaw 23 is made of a ZL4 alloy having a composition Zn:A14:Cu1. The ZL4 alloy is adequate for pressure casting.

The mechanism of the invention for locking the door of an electric household appliance is embodied like the represented known mechanism.

The slider 2 is provided with a labyrinth defining direction of displacement of the slider 2 at a single thrust on the slider 2. The latch 3 is fastened to the door of an electric household appliance. The latch 3 thrusts the body 22 of the slider 2 when closing and opening the door of an electric household appliance.

When closing the door of an electric household appliance the latch head 31 is snapped by the tooth 231 of the slider jaw 23 in order for the door of the electric household appliance to lock. The slider 2 is translatory movable in the housing 1 by means of an assembly of a guiding groove 21 and a guiding cam 11, namely in the direction against the force of the spring 4 during closing of the door of an electric household appliance and in direction of the force of the spring 4 during opening of the door of an electric household appliance. In a known way, the housing 1 is provided with a cam lobe 12 lifting the slider jaw 23 and closing it hereby, when the latch 3 thrusts the slider 2 in direction against the force of the spring 4.

The invention claimed is:

1. A mechanism for locking a door of an household appliance, comprising:

a housing, said housing having a through hole extending through a lower face of said housing, said through hole having a hindering edge formed by one end thereof;

a slider slidably disposed within said housing;

said slider having a body and a slider jaw pivotally hinged to said body;

said slider jaw having a tooth disposed on a surface thereof and an opening finger at a surface opposite to said slider jaw tooth;

a latch having a head and a second end, wherein said second end is attached to said door of said appliance, said latch thrusts said slider by closing and opening of the door of said household appliance, said latch head is engagable with said slider jaw tooth when said door of said household appliance is closed;

a spring disposed within said housing and providing a bias against linear movement of said slider in a direction against a force of the spring on the slider during the closing of said door and in a direction of the force of the spring on the slider during opening of said door;

a protrusion extending upwardly from the lower face of said housing, said protrusion engaging to lift and engage said slider jaw tooth with the latch head when said latch thrusts the slider within said housing against the force of said spring;

wherein the slider jaw tooth engages or releases said head of said latch; and, wherein said opening finger slides within said through hole when said latch thrusts the slider within the housing against the force of the spring such that said opening finger engages with said hindering edge of said through hole to disengage said slider jaw tooth from said head of said latch.

2. The mechanism as recited in claim 1, wherein the body of the slider and the slider jaw are made of different materials.

3. The mechanism as recited in claim 2, wherein the body of the slider is made of a polyoxymethylene copolymer and the slider jaw is made of a polyamide.

4. The mechanism as recited in claim 1, wherein the body of the slider is made of a polyoxymethylene copolymer and the slider jaw is made of an alloy having a composition Zn:A14: Cu1.

5. The mechanism as recited in claim 1, wherein the slider body further comprises axle pins and the slider jaw further comprises axle holes positioned to receive said axle pins.

6. The mechanism as recited in claim 1, wherein the slider jaw further comprises axle pins and the slider body further comprises axle holes-positioned to receive said axle pins.

7. The mechanism as recited in claim 1, wherein the slider body and the slider jaw are provided with axle holes, said mechanism further comprising an axle pin dimensioned and configured to be received within said slider jaw and said slider body.

* * * * *